United States Patent [19]

Tajima et al.

[11] Patent Number: 4,538,896

[45] Date of Patent: Sep. 3, 1985

[54] UNIT FOR AN IMAGE FORMATION APPARATUS AND IMAGE FORMATION APPARATUS PROVIDED WITH THE SAME UNIT

[75] Inventors: Hatsuo Tajima, Matsudo; Tohru Takahashi, Tokyo; Nagao Hosono, Chofu, all of Japan

[73] Assignee: Canon Kabushiki Kaisha, Tokyo, Japan

[21] Appl. No.: 633,061

[22] Filed: Jul. 20, 1984

Related U.S. Application Data

[63] Continuation of Ser. No. 356,026, Mar. 8, 1982, abandoned.

[30] Foreign Application Priority Data

Mar. 18, 1981 [JP] Japan ..... 56-38892

[51] Int. Cl.[3] ..... G03G 15/08

[52] U.S. Cl. ..... 355/3 R; 355/3 DR; 355/3 DD; 118/653; 118/652

[58] Field of Search ..... 355/3 R, 14 R, 3 DR, 355/3 DD, 140; 118/657, 654, D165, 653, 652

[56] References Cited

U.S. PATENT DOCUMENTS

| | | | |
|---|---|---|---|
| 3,666,363 | 5/1972 | Tanaka et al. | 355/8 |
| 3,700,323 | 10/1972 | Guyette et al. | 355/3 |
| 3,736,053 | 5/1973 | Shreeve et al. | 355/3 |
| 3,918,402 | 11/1975 | Ohta | 118/DIG. 5 X |
| 3,966,316 | 6/1976 | Pfeifer et al. | 355/3 |
| 3,985,436 | 10/1976 | Tanaka et al. | 355/8 |
| 4,181,422 | 1/1980 | Forgo et al. | 355/3 DD |
| 4,236,807 | 12/1980 | Kuehnle | 355/3 |
| 4,240,375 | 12/1980 | Terashima | 355/3 DD X |
| 4,251,155 | 2/1981 | Schnall et al. . | |
| 4,286,861 | 9/1981 | Matsumoto et al. | 355/3 |
| 4,386,838 | 6/1983 | Hirabayashi et al. | 355/3 |

*Primary Examiner*—A. C. Prescott

*Attorney, Agent, or Firm*—Fitzpatrick, Cella, Harper & Scinto

[57] ABSTRACT

A unit removably mountable to the body of an image formation apparatus such as an electrophotographic copying apparatus or an information recording apparatus. An image formation apparatus provided with such unit. The unit has an image bearing member, and a developer containing portion having a volume capable of containing the total amount of developer consumed by developing device for developing images formed on the image bearing member, during the durability period of the unit.

33 Claims, 8 Drawing Figures

UNIT FOR AN IMAGE FORMATION APPARATUS AND IMAGE FORMATION APPARATUS PROVIDED WITH THE SAME UNIT

This application is a continuation of application Ser No. 356,026 filed Mar. 8, 1982, now abandoned.

BACKGROUND OF THE INVENTION

1. Field of the Invention

This invention relates to a unit removably mountable to the body of an image formation apparatus such as an electrophotographic copying apparatus or an information recording apparatus. It also relates to an image formation apparatus provided with such unit.

2. Description of the Prior Art

Description will hereinafter be made, for example, of an electrophotographic copying apparatus.

In the electrophotographic copying apparatus of the prior art, interchange or supply of expendables is carried out in the following manner. For example, interchange of the photosensitive drum as an image bearing member, which is rotatably supported on a shaft fixed to the apparatus body, is accomplished by removing a shaft fixing member fixed to a side plate of the apparatus body, and then withdrawing the drum from the shaft. Supply of toner to the developing device hopper containing toner therein is accomplished by knowing the toner supply time from detecting means (such as, for example, a device for detecting the amount of remaining toner) provided in the developing device or hopper, and then supplying toner to the hopper.

Since the hopper is fixedly provided in the body of the apparatus, not only is it difficult to supply toner to the hopper but also scattered toner may ingress into the apparatus body to contaminate the interior thereof. Further, waste toner collected from the photosensitive medium by a cleaner is stored in the interior of the apparatus body and must be thrown away when suitable detector means detects that the waste toner container is almost full of waste toner.

When the waste toner is thrown away, the container must be moved while keeping its horizontal position and therefore, the toner can be split or scattered thereby contaminating the interior and exterior of the apparatus or contaminating the clothes of the operator.

As described above, with the prior art apparatus, interchange or supply of expendables is cumbersome and there is the undesirable possibility of contaminating the interior and exterior of the apparatus or contaminating the clothes of the operator. Moreover, since supply and discarding of the drum and toner are carried out individually service is, the number of times required is increased.

Furthermore, the number of portions for mounting respective expendables to the apparatus body has increased and this has led to complexity of the apparatus.

For these reasons, a technique disclosed in U.S. Pat. No. 3,985,436 has been proposed. However, with this technique, even if toner remains in the toner supply device, the unit must sometimes be interchanged when other expendables reach the end of their life. This may lead to waste of developer.

SUMMARY OF THE INVENTION

It is an object of the present invention to provide a unit which simply enables interchange of expendables and an image formation apparatus provided with such a unit.

It is another object of the present invention to provide a unit which eliminates the necessity of supplying developer during the life of the unit and moreover does not waste developer and an image formation apparatus provided with such unit.

The unit of the present invention is removably mountable to the body of an image formation apparatus and has an image bearing member, and a developer containing portion having a volume capable of containing the total amount of developer consumed by developing means for developing images formed on the image bearing members, during the life of the unit. In another aspect, the present invention provides an image formation apparatus provided with such a unit.

Thus, the present invention enables interchange of expendables to be simply accomplished. Also, the present invention eliminates the necessity of supplying developer during the life of the unit and prevents the developer from being wasted.

The invention will become more fully apparent from the following detailed description thereof taken in conjunction with the accompanying drawings.

DESCRIPTION OF THE PREFERRED EMBODIMENTS

The present invention will hereinafter be described in more detail with respect to an embodiment thereof.

Figure 1:
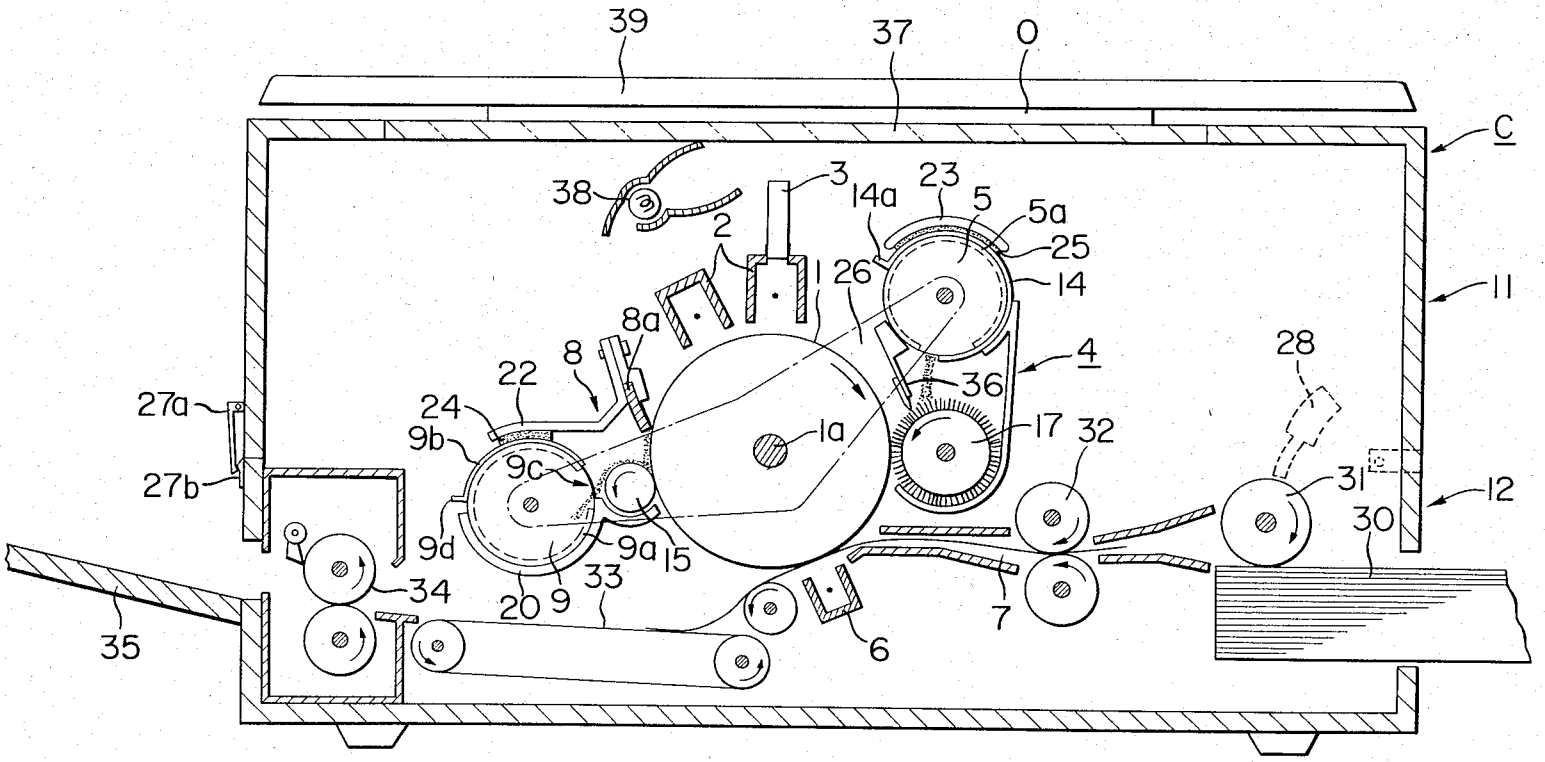
FIG. 1 is a cross-sectional view of a copying apparatus using an embodiment of the present invention.
Figure 2:
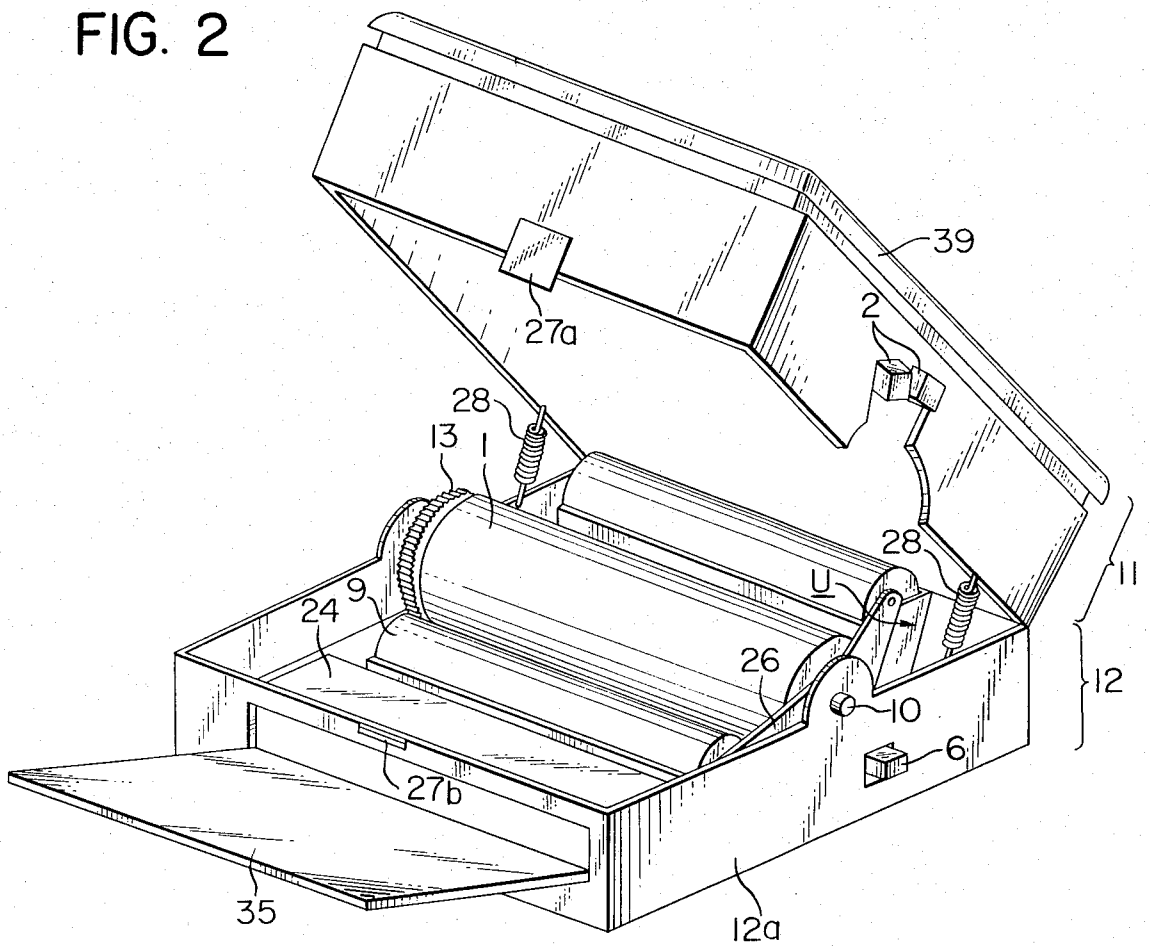
FIG. 2 is a perspective view of the copying apparatus.
Figure 3:
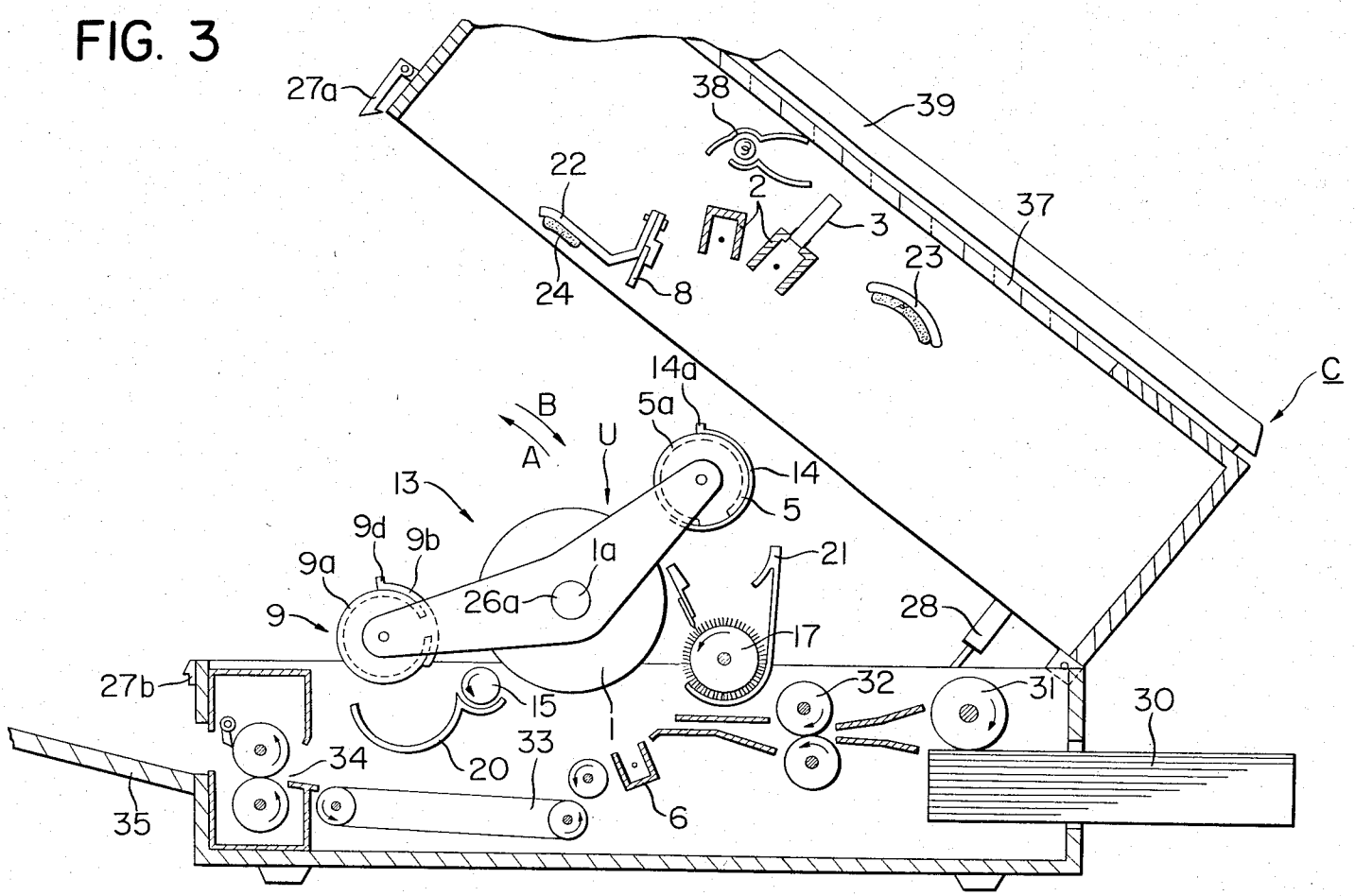
FIG. 3 is a cross-sectional view showing an opened condition of the copying apparatus.
Figure 4:
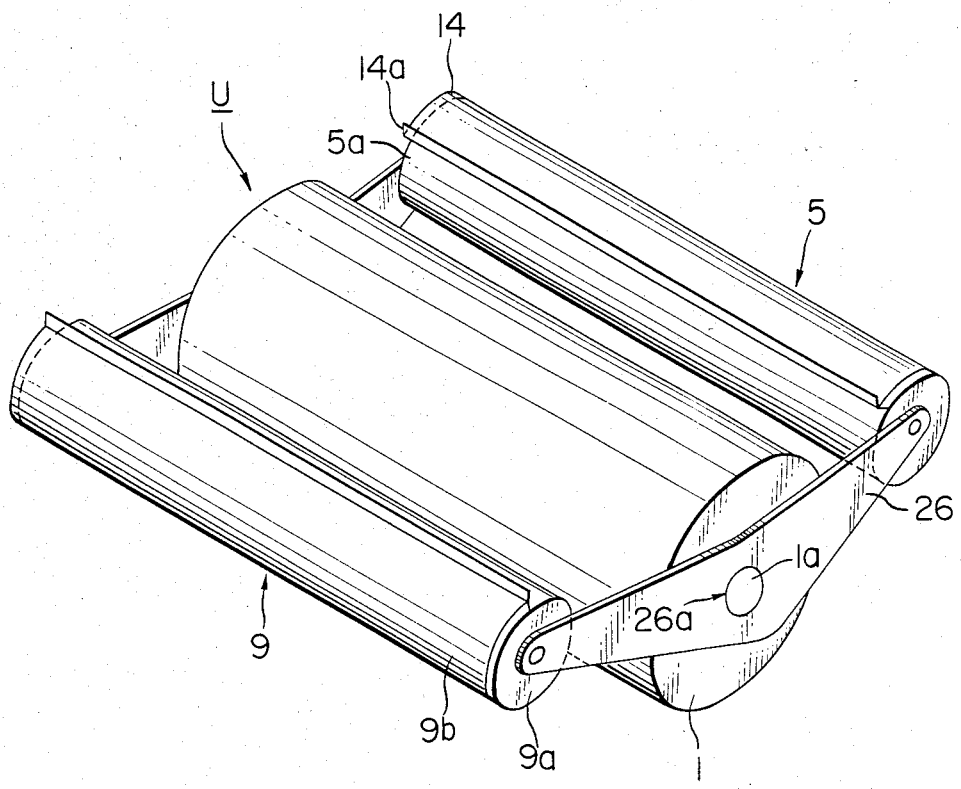
FIG. 4 is a perspective view of the unit.

FIG. 1 is a cross-sectional view of an electro-photographic copying apparatus equipped with an expendable interchange unit comprising a photosensitive drum, a hopper as toner containing means and a waste toner container which have been made integral with one another, FIG. 2 is a perspective view showing a condition in which the apparatus body has been divided and opened, and FIG. 3 shows a case where the expendable interchange unit has been removed from the apparatus body or is mounted to the apparatus body. FIG. 4 is a perspective view of the unit.

In the figures, reference numeral 1 designates a photosensitive drum covered with a photoconductive layer. The photosensitive drum 1 may be one which has or does not have an insulating layer on the surface thereof, and may of course be in the form of a sheet or a belt. Reference numeral 2 designates corona dischargers, and reference numeral 3 designates light image applying means for projecting an original image or light image or a light beam or the like modulated by an image signal. In the figures, the reflected light image of an original 0 illuminated by an illuminating lamp 38 is projected onto the photosensitive drum 1 by the light image applying means 3.

An electrostatic image is formed on the photosensitive drum 1 by these means. The electrostatic image forming process may be the Carlson process, the process described in U.S. Pat. No. 3,666,363, or another known process. Designated by 4 is a developing device using a one-component high resistance magnetic toner utilizing the phenomenon described, for example, in U.S. application Ser. No. 938,494 (filed Aug. 31, 1978). Denoted by 5 is a hopper for toner supplied to a magnetic brush roller 17, and toner is contained in the hopper 5. Reference numeral 6 designates an image transfer discharger for transferring to a transfer medium 7 such as a sheet the toner image visualized on the photosensitive drum 1 by the developing device 4. Reference numeral 8 denotes cleaning means for removing any remaining toner on the photosensitive drum 1 after the image transfer to thereby make the photosensitive drum ready for reuse. In the figures, the cleaning means is shown as using a blade cleaner 8*a*. Designated by 9 is a container for waste toner resulting from the cleaning of the photosensitive drum 1.

In the present embodiment, the photosensitive drum 1, the hopper 5 and the waste toner container 9 are integrally mounted to an arm 26 and form an expendable interchange unit U. As shown in FIG. 2, the unit U is removably mounted on the apparatus body by means of a shaft 10. In the present embodiment, the shaft 10 is mounted to the side plate 12*a* of the lower apparatus body 12 and the photosensitive drum 1 1 is rotatable relative to the shaft 10. The photosensitive drum is operatively associated with and rotated by a drum driving gear 13 which receives the rotation transmitted from a motor (not shown) by a gear train (not shown).

Designated by 15 is a conveying screw for directing to the container 9 the toner scraped off the photosensitive drum 1 by the blade cleaner 8*a*. Reference numeral 30 designates a cassette, reference numeral 31 denotes a transfer medium feeding roller, reference numeral 32 designates register rollers, reference numeral 33 denotes a conveyor belt, reference numeral 34 designates fixing means, reference numeral 35 denotes a tray, and reference numeral 36 designates an ear cutting plate. Reference numeral 37 designates an original supporting glass, reference numeral 38 denotes an illuminating lamp, and reference numeral 39 designates an original pressing plate.

Removal or mounting of the expendable interchange unit U with respect to the apparatus body is accomplished in the following manner.

First, the engagement between a hook 27*a* and a stud 27*b* is released and the upper body 11 is upwardly raised by the raising force of coil springs 28 to thereby separate and open the upper body 11 relative to the lower body 12 (see FIGS. 2 and 3).

A packing 24 for positioning the cleaning means 8 and toner container 9 at predetermined positions and a support plate 22 for supporting the packing 24 and further, a packing 25 for positioning the hopper 5 at a predetermined position and a support plate 23 for supporting the packing 25, all these being mounted to the upper body 11, are moved with the movement of the upper body 11. Thus, the hopper 5 and the waste toner container 9 become removable from their respective receiving members 21 and 20. Accordingly, by withdrawing the shaft 10 from the side plate 12*a*, the expendable interchange unit U can be removed from the apparatus body. Thus, the photosensitive drum 1, the hopper 5 and the toner container 9 which are expendable can be removed as a unit from the apparatus body (the direction of arrow A in FIG. 3).

Description will now be made of a case where the unit U is mounted to the apparatus body.

First, the hopper 5 and the toner container 9 are placed in alignment with the receiving members 21 and 20, respectively, provided on the lower body 12 (the direction of arrow B in FIG. 3). The shaft 10 is then inserted into the shaft opening 1*a* of the drum 1 through the side plate 12*a*, whereby the positioning of the drum is effected. The shaft 10 passes also through an opening 26*a* formed in that portion of the arm 26 which corresponds to the opening 1a. Subsequently, the upper body 11 is depressed against the raising force of the springs 28 to bring the hook 27*a* into engagement with the stud 27*b*. Thereupon, the hopper 5 and the toner container 9 are pressed against the receiving members 21 and 20, respectively, by the packings 24 and 25 and thus are mounted at predetermined positions.

Thus, in the present embodiment, by opening the body C and removing the drum shaft 10 from the body, the expendables can be readily removed as a unit from the body and replaced with a new unit.

The use of the packings 24 and 25 can ensure the mountability with which the waste toner container 9 and the hopper 5 are loaded onto the receiving members 20 and 21, respectively. Further, if the positioning of the photosensitive drum 1 is effected by the support member (not shown) of the arm 26 when the positioning of the waste toner container 9 and the hopper 5 has been effected, the shaft 10 may be eliminated. In this case, it is desirable that the arm 26 be mounted to both sides of the unit U. In FIG. 2, the outer frame of the copying apparatus body is not shown.

Description will now be made of an example in which the toner stored in the hopper 5 is supplied to the magnetic brush roller 17.

Figure 5A:
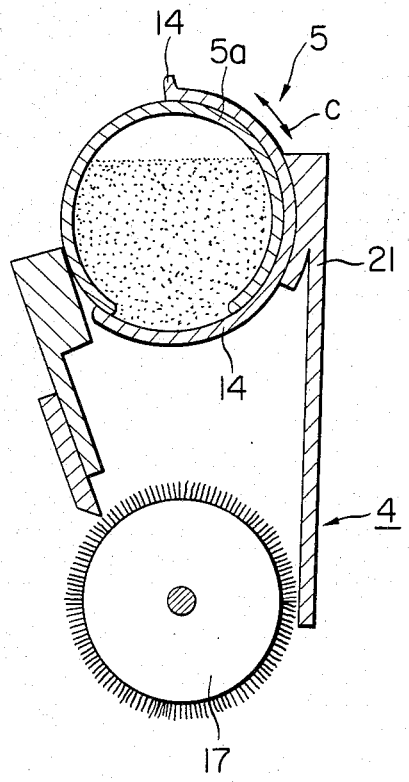
FIGS. 5A and 5B are enlarged cross-sectional views of a portion of the developing device.
Figure 5B:
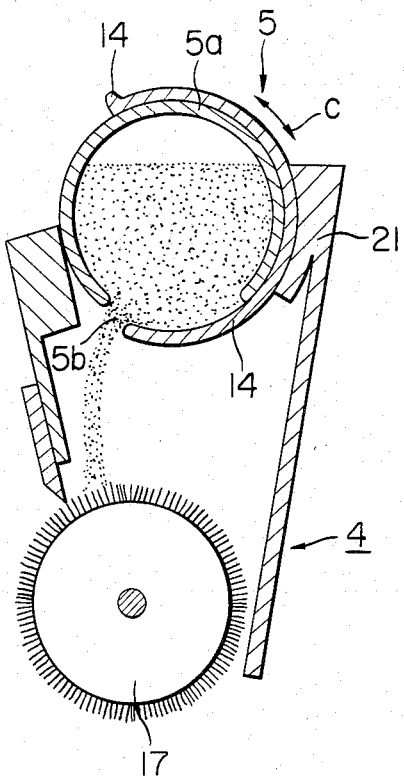

In the present embodiment, an openable-closable plate 14 is provided which is slidable along the cylindrical wall 5*a* of the hopper (in the direction of arrow C). The area of an opening 5*b* in the cylindrical wall 5*a* of the hopper can be adjusted by causing the openable-closable plate 14 to slide along the cylindrical wall 5*a* by a knob 14*a* provided on the openable-closable plate 14. The amount of toner supplied to the magnetic brush roller 17 can be adjusted in accordance with the area of this opening. Thus, in the present embodiment, the amount of toner supplied can be adjusted simply by causing the openable-closable plate 14 to slide (FIG. 5B). Further, if the opening 5*b* is fully closed by the openable-closable plate 14 (FIG. 5A), scattering of toner or contamination by toner leaking from the hopper 5 can be prevented when the unit U is removed. The closing of the opening 5*b* of the hopper 5 may also be accomplished by the use of a sticky tape. Further, a similar construction may of course be used to open or close an opening for collecting the toner in the waste toner container 9. That is, an openable-closable plate 9*b* slidable along the cylindrical wall 9*a* of the waste toner container 9 is provided on the waste toner container 9. The opening-closing of an opening 9*c* in the cylindrical wall 9*a* can be accomplished by causing the openable-closable plate 9*b* to slide along the cylindrical wall 9*a* by means of a knob 9*d*.

Figure 6:
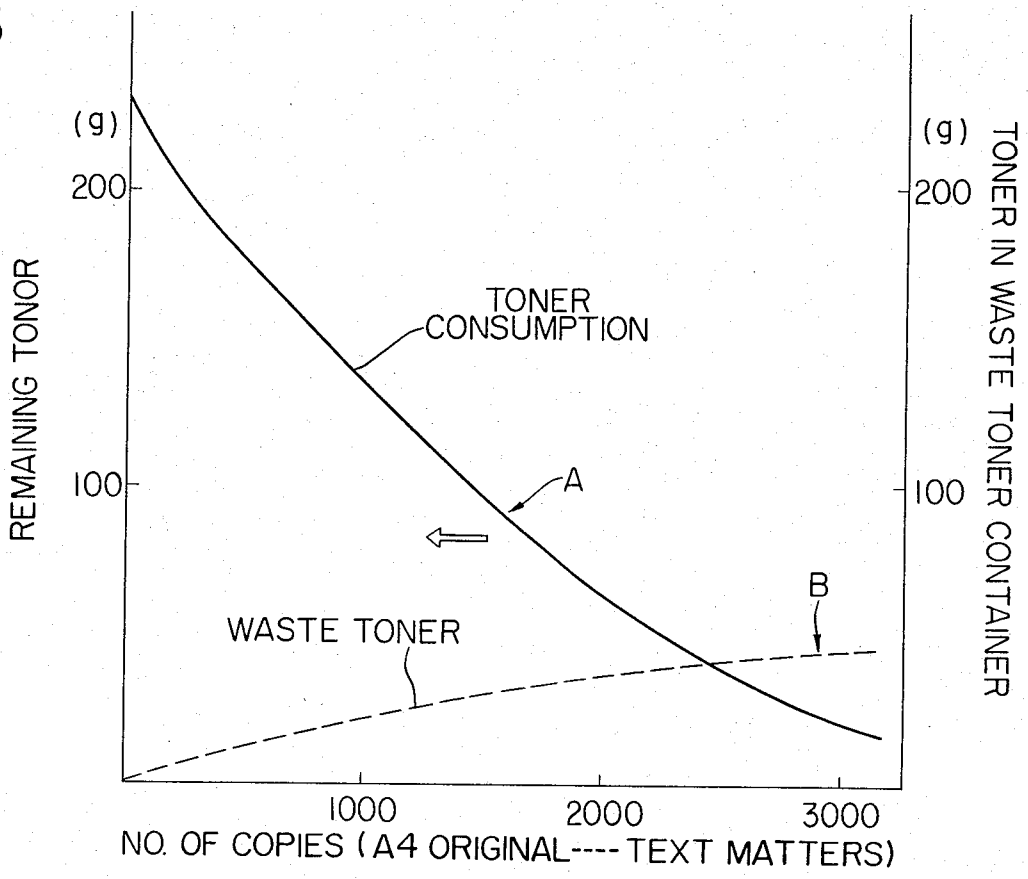
FIG. 6 is a graph illustrating the amount of toner consumed and the amount of waste toner.

FIG. 6 shows the relation among the number of copies, the amount of remaining toner in the hopper 5 and the amount of collected waste toner in the waste toner container 9. Here, (the amount of toner consumed) = (- the amount of toner initially thrown into the hopper 5) − (the amount of remaining toner in the hopper 5). As will be understood from the graphs, the amount of toner in the hopper 5 decreases with increasing number of copies (A4 original text matters) (graph A), while the amount of waste toner contained in the waste toner container 9 increases with increasing number of copies (graph B). The ratio of the amount of consumed toner to the amount of waste toner is approximately 5:1. However, this value becomes somewhat irregular depending on changes in the environment and the contents of copy images. The graph refers to a case where use was made of a photosensitive medium durable for 3,000 sheets, and shows that if about 210 g of toner is thrown into the hopper 5, toner consumption is substantially completed with lapse of the durability period i.e. the service life of the photosensitive medium. Accordingly, an amount of toner to be consumed in accordance with the number of sheets for which the photosensitive medium is durable can be contained in the hopper 5 and the size of the waste toner container in the hopper can be determined in accordance with the number of sheets for which the photosensitive medium is durable.

In the case of common original images, the ratio of the amount of consumed toner to the amount of waste toner is 5:1 and therefore, where the hopper and the waste toner container are made integral with each other, the volume ratio of the two can be made into approximately 5:1. Thus, an unnecessarily large waste toner container 9 need not be provided.

Therefore, in the present embodiment, the volume of the hopper 5 may be a volume capable of containing the amount of toner consumed during the service life of the photosensitive medium and the volume of the waste toner container 9 may be a volume capable of containing the amount of waste toner collected from the photosensitive medium during the service life thereof. For example, in the case of the present embodiment, when common original text matters are copied by the use of a photosensitive medium which is durable for 3,000 sheets, the volume of the hopper may be about 500 $cm^3$ and the volume of the waste toner container 9 may be about 100 $cm^3$ in order to store about 200 g of toner.

Further, where the waste toner container 9 and the hopper 5 are made integral as the unit U, the waste toner container 9 may be set so as to have a volume of at least one-fifth of the volume of the hopper 5. If the toner containing volume of the hopper 5 is thus determined in accordance with the service life of the photosensitive medium, it is also possible for the photosensitive medium to reach its service life by completion of the consumption of toner and thus, the photosensitive medium can be prevented from being used beyond its service life. Also, even if the unit is discarded after lapse of the service life of the photosensitive medium, the toner in the hopper 5 will have substantially been consumed by that time and the toner will not be wasted. If the volume of the waste toner container is determined in accordance with the volume of the hopper, it will not be necessary to make the waste toner container inadvertently large. Also, where the unit is to be interchanged upon completion of the consumption of toner, provision may be made of display means or display function for informing in advance that the amount of remaining toner has become small.

While the present embodiment has been shown with respect only to a case where the photosensitive drum 1, the hopper 5 and the waste toner container 9 are integrally mounted to the arm 26, the present embodiment is not limited thereto, but of course at least two of said three members may be combined and made integral with each other.

Figure 7:
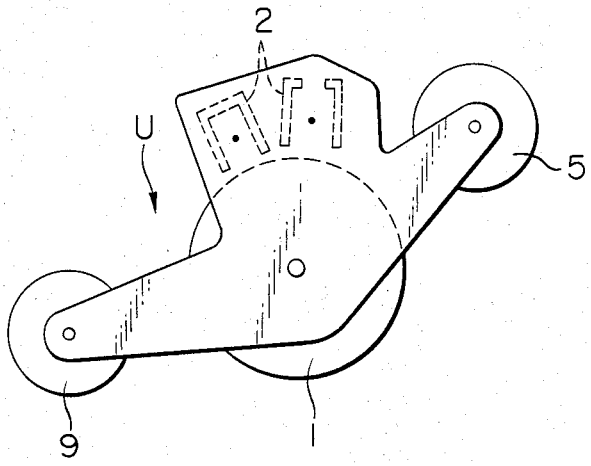
FIG. 7 is a side view of another embodiment of the unit.

Further, by making charging means, e.g. a corona discharger integral with the above-described unit as shown in FIG. 7, corona discharge wire and charger contaminated by toner also become interchangeable at the termination of a predetermined durability period of expendables, for example, the termination of the service life of the photosensitive medium.

FIG. 7 shows an arrangement in which the photosensitive drum 1, the discharger 2, the hopper 5 and the waste toner container 9 are integrally mounted to the holder 40 of the unit U.

As described above, individual expendables have heretofore been separately supplied and interchanged and this has led to a number of complicated devices for mounting and dismounting the respective expendables with respect to the apparatus body. In the present invention, the mounting and dismounting of the above-mentioned individual devices is made unnecessary by making the expendables integral, that is, by making at least the image bearing member and the developer container integral, and thus the construction of the apparatus can be made simple. Also, by combining at least two of the waste toner container, the hopper and the photosensitive drum and making them integral, it is possible to carry out toner supply and interchange of the photosensitive medium, or interchange of the photosensitive medium and treatment of waste toner, or toner supply and treatment of waste toner, or toner supply, treatment of waste toner and interchange of the photosensitive medium, concomitantly at the termination of the predetermined durability period of the expendables. Likewise, the cleaner itself and the developing device itself can also be made integral by combination thereof with other members so that they can be interchanged during interchange of expendables. Furthermore, during interchange of the drum, the portion which is to be in contact with drum when installed had to be kept in non-contact condition in order to prevent the drum from being damaged and for example, mechanisms have been necessary for spacing the cleaning member, the developing device, etc. apart from the drum. However, such mechanisms are not necessary in the construction of the present invention.

Also, by making the expendables integral and interchangeable, minimum limits of expendables necessary during the durability period of the expendables may be provided in the apparatus and this leads to compactness of the apparatus.

While the present embodiment has been described by taking a photosensitive drum as an example of the image bearing member, the present invention is not restricted thereto, but the image bearing member may be, for example, an insulating drum or a magnetic drum.

What we claim is:

1. An image forming apparatus for forming an image on a transfer medium, said apparatus comprising:

An expendable interchange unit detachably mounted to said image forming apparatus and including at least a non-refillable supply means for storing a predetermined amount of developer and an image bearing member having a service life corresponding essentially to the developer capacity of said supply means;

means for forming an image on said image bearing member;

means for developing the image formed on said image bearing member with developer from said supply means; and means for transferring the developed image to a transfer medium;

wherein said interchange unit is discardable and replaceable with another unit upon the substantial consumption of the predetermined amount of developer in said supply means, thereby avoiding periodic replenishment of developer during the service life of said image bearing member.

2. An image forming apparatus according to claim 1, wherein said expendable interchange unit further includes sealing means for sealing an opening in said supply means through which the developer is supplied to said developing means.

3. An image forming device according to claim 1, wherein said expendable interchange unit further includes said developing means.

4. An image forming device according to claim 1 or 3, wherein said expendable interchange unit further includes cleaning means for removing waste developer from said image bearing member after transfer of the developed image and collecting means for collecting a predetermined amount of waste developer removed by said cleaning means, and wherein the service life of said image bearing member also corresponds essentially to the waste developer capacity of said collecting means.

5. An image forming device according to claim 4, wherein the ratio of the capacity of said supply means to the capacity of said collecting means is approximately 5:1.

6. An image forming device according to claim 4, wherein said expendable interchange unit further includes sealing means for sealing an opening in said collecting means through which waste developer is collected.

7. An image forming device according to claim 1 or 3, wherein said expendable interchange unit further includes a corona device.

8. An image forming device according to claim 4, wherein said expendable interchange unit further includes a corona device.

9. An image forming device according to claim 1, wherein the service life of said image bearing member is approximately three thousand image formations or less.

10. An image forming apparatus according to claim 4, wherein the service life of said image bearing member is approximately three thousand image formations or less.

11. An expendable interchange unit for attachment to and detachment from an image forming apparatus for forming an image on a transfer medium, said unit comprising:

non-refillable supply means for storing a predetermined amount of developer; and an image bearing member for bearing an image to be developed and transferred to the transfer medium, said image bearing member having a service life corresponding essentially to the developer capacity of said supply means;

wherein the entire interchange unit is discardable and replaceable with another unit upon the substantial consumption of the predetermined amount of developer, thereby avoiding periodic replacement of developer during the service life of said image bearing member.

12. An expendable interchange unit according to claim 11, further comprising sealing means for sealing an opening in said supply means through which developer is supplied for development.

13. An expendable intercharge unit according to claim 11, further comprising a developing device.

14. An expendable interchange unit according to claim 11 or 13, further comprising cleaning means for moving waste developer from said image bearing member and collecting means for collecting a predetermined amount of waste developer removed by said cleaning means, wherein the service life of said image bearing member also corresponds essentially to the waste developer capacity of said collecting means.

15. An expendable interchange unit according to claim 14, wherein the ratio of the capacity of said supply means to the capacity of said collecting means is 5:1.

16. An expendable interchange unit according to claim 14, further comprising sealing means for sealing an opening in said collecting means through which waste developer is collected.

17. An expendable interchange unit according to claim 11 or 13, further comprising a corona device.

18. An expendable interchange unit according to claim 14, further comprising a corona device.

19. An expendable interchange unit according to claim 11, wherein the service life of said image bearing member is approximately three thousand image formations or less.

20. An expendable interchange unit according to claim 14, wherein the service life of said image bearing member is approximately three thousand image formations or less.

21. An image forming method comprising the steps of:

attaching an expendable interchange unit to an image forming apparatus for forming a developed image on a transfer medium, said unit including a non-refillable developer supply for storing a predetermined amount of developer and an image bearing member having a service life corresponding essentially to the developer capacity of the developer supply;

forming an image on the image bearing member;

developing the formed image with developer from the developer supply;

transferring the developed image to the transfer medium;

repeating the image formation, development and transfer steps to form additional images on transfer mediums; and detaching and discarding the expendable interchange unit when the predetermined amount of developer in the developer supply is substantially exhausted.

22. A method according to claim 21, further comprising the step of replacing the detached expendable interchange unit in which the predetermined amount of developer has been substantially exhausted with another expendable interchange unit.

23. A method according to claim 21, wherein the expendable interchange unit further includes sealing means for sealing an opening in the developer supply and further comprising the step of unsealing the opening prior to attaching the expendable interchange unit to the image forming apparatus.

24. A method according to claim 21, wherein the expendable interchange unit further includes a developing device.

25. A method according to claim 21 or 24, wherein the expendable interchange unit further includes a cleaning device for removing waste developer from the image bearing member and a collecting device for collecting a predetermined amount of waste developer removed by the cleaning device, and wherein the service life of the image bearing member also corresponds essentially to the waste developer capacity of the collecting device.

26. A method according to claim 25, wherein the expendable interchange unit further includes a corona device.

27. An image forming apparatus for forming an image on a tranfer medium, said apparatus comprising:

an expendable interchange unit detachably mounted to said image forming apparatus and including collecting means for collecting a predetermined amount of waste developer and an image bearing member having a service life corresponding essentially to the waste developer capacity of said collecting means;

means for forming an image on said image bearing member;

means for developing the image formed on said image bearing member;

means for transferring the developed image to a transfer medium; and cleaning means for removing waste developer from said image bearing member after transfer of the developed image;

wherein said interchange unit is discardable and replaceable with another unit when said collecting means becomes substantially full of waste developer removed by said cleaning means, thereby avoiding periodic disposal of waste developer during the service life of said image bearing member.

28. An image forming apparatus according to claim 27, wherein said expendable interchange unit further includes said cleaning means.

29. An expendable interchange unit for attachment to and detachment from an image forming apparatus for forming an image on a transfer medium, said unit comprising:

collecting means for collecting a predetermined amount of waste developer; and an image bearing member for bearing an image to be developed and transferred to the transfer medium and from which waste developer is removed after transfer, said image bearing member having a service life corresponding essentially to the waste developer capacity of said collecting means;

wherein the entire interchange unit is discardable and replaceable with another unit when said collecting means becomes substantially full of waste developer, thereby avoiding periodic disposal of waste developer during the service life of said image bearing member.

30. An expendable interchange unit according to claim 29, further comprising cleaning means for removing waste developer from said image bearing member.

31. An image forming method comprising the steps of:

attaching an expendable interchange unit to an image forming apparatus for forming a developed image on a transfer medium, said unit including collecting means for collecting a predetermined amount of waste developer and an image bearing member having a service life corresponding essentially to the waste developer capacity of the collecting means;

forming an image on the image bearing member;

developing and transferring the image to the transfer medium;

collecting waste developer from the image bearing member in the collecting means after image transfer;

repeating the forming, developing, transferring and collecting steps to form additional developed images on transfer mediums; and detaching and discarding the expendable interchange unit when the collecting means becomes substantially full of waste developer.

32. A method according to claim 31, further comprising the step of replacing the detached expendable interchange unit which is substantially full of waste developer with another expendable interchange unit.

33. A method according to claim 31, wherein the expendable interchange unit further includes a cleaning device for removing waste developer from the image bearing member.

* * * * *